US005833758A

United States Patent [19]

Linn et al.

[11] Patent Number: 5,833,758

[45] **Date of Patent: *Nov. 10, 1998**

[54] METHOD FOR CLEANING SEMICONDUCTOR WAFERS TO IMPROVE DICE TO SUBSTRATE SOLDERABILITY

[75] Inventors: Jack H. Linn, Melbourne; Mark A. Kwoka, Palm Bay, both of Fla.

[73] Assignee: Harris Corporation, Melbourne, Fla.

[ * ] Notice: The term of this patent shall not extend beyond the expiration date of Pat. No. 5,451,263.

[21] Appl. No.: 754,596

[22] Filed: Nov. 20, 1996

Related U.S. Application Data

[63] Continuation of Ser. No. 385,247, Feb. 7, 1995, abandoned.

[51] Int. Cl.[6] ..... B08B 7/00

[52] U.S. Cl. ..... 134/1.2; 216/79

[58] Field of Search ..... 134/1, 1.1, 1.2; 204/192.32, 192.37; 216/77, 79; 438/710

[56] References Cited

U.S. PATENT DOCUMENTS

| | | | |
|---|---|---|---|
| 4,797,178 | 1/1989 | Bui et al. | 134/1 |
| 5,252,181 | 10/1993 | Dutartre | 134/1.1 |
| 5,451,263 | 9/1995 | Linn et al. | 134/1.1 |

*Primary Examiner*—Jill Warden
*Assistant Examiner*—Saeed Chaudhry
*Attorney, Agent, or Firm*—Daniel J. Staudt

[57] ABSTRACT

A method of plasma cleaning semiconductor wafers for subsequent soldering the dice cut from the semiconductor wafers to a substrate. The plasma cleaning removes all contaminants such that the semiconductor dice has improved solderability.

12 Claims, 2 Drawing Sheets

METHOD FOR CLEANING SEMICONDUCTOR WAFERS TO IMPROVE DICE TO SUBSTRATE SOLDERABILITY

This application is a continuation, of application Ser. No. 08/385,247 filed Feb. 7, 1995, now abandoned.

The invention relates to the cleaning of semiconductor wafers for subsequent attachment of the dice cut from the semiconductor wafers to a substrate. Specifically, the invention relates to the plasma cleaning of the semiconductor wafer to improve the solderability of the dice cut from the semiconductor wafer to a substrate such as a package or circuit board.

During the manufacturing of semiconductor wafers, the wafers are processed with over a hundred semiconductor integrated circuits thereon. Each semiconductor circuit may have several hundred to thousands of transistors and other devices for making the integrated circuit function. At the end of processing of the semiconductor wafers the backside or non-device surface of the wafers are thinned in order to reduce the thickness of the wafers.

Once the wafers are thinned a film structure is often deposited on the backside of the wafers to enhance the solderability of the backside of the wafer for attachment to a substrate. The film structure will be described in more detail below. The film on the wafers is often cleaned to remove surface contaminants. It is this cleaning that the present invention is focused upon. Subsequently, the wafer is cut into separate dice which separates each integrated circuit from the wafer. These dice can then be attached to a package such as a DIP (Dual in-line Package) where specific inputs and outputs to the circuit are wire bonded to the pins of the package. These pins extend out the exterior of the DIP for implementation of the integrated circuit into an electronic system such as a printed circuit board.

The semiconductor dice can also be directly mounted to a printed circuit board and wire bonded via bond wires to the bond pads on the die and circuit board. Several semiconductor dice maybe mounted to a circuit board used in an electronic system.

The film structure deposited on the backside of the wafers after the wafers are thinned generally comprises a tri-metal or quad-metal structure. In the tri-metal structure, the exposed metal is nickel. In the past, once the nickel was deposited on the backside of the wafer, the wafer was hydrogen fired to remove the oxides and contaminants from the surface of the nickel thus cleaning the surface. Hydrogen firing is a process where the backside of the wafers are exposed to a hydrogen ambient at elevated temp., usually above 250° C. It is imperative that all of the surface contaminants be removed in order for the dice to be solderable for attachment to a substrate.

The use of hydrogen fire has several disadvantages. The hydrogen fire does not always produce solderable dice, it is costly, and provides safety concerns. Hydrogen firing is intended to chemically reduce all of the oxides to the metal but generally only reduces some of the oxides. Furthermore, many times the wafers must be hydrogen fired several times in order to remove all surface contaminants and reduce the oxides.

Once the wafers are hydrogen fired a solderability test is performed to determine if the firing has been successful. If the wafers pass the solderability test then they are cut into individual dice. Oftentimes the wafers are cut based upon a positive solderability test only to find out subsequently that the sawn dice are unsolderable, thus becoming scrap.

Furthermore, after hydrogen firing of the wafers, some analysis have shown the presence of carbonaceous compounds and other non-oxide contaminants on the surface of the nickel. This type of contaminant will not be removed by hydrogen firing and will inhibit solderability.

The alternative structure is to use gold in the quad-metal film structure. In the quad-metal structure gold is deposited on top of the nickel. Gold also has its disadvantages. Gold is expensive and does not lend itself to be a conforming film such that if the wafer is rough from the wafer thinning process, the gold will not cover the entire surface, thus, allowing the nickel to diffuse across the backside surface of the wafer. The exposed nickel will then oxidize. This diffused nickel oxide will hinder and limit the solderability of the subsequent cut dice.

Others have attempted to improved the solderability by changing the film structure to some other type of metal but again this has been more costly. For example, in the past the nickel has been replaced with silver. The use of silver has the advantage of alleviating the extra cleaning steps but has increased the cost per wafer tremendously.

Thus there is a need to provide a method of cleaning the wafers for subsequent soldering that provides a clean oxide free surface and is cost effective.

DESCRIPTION OF THE INVENTION

Typically, once the semiconductor wafer is processed and cut into separate dice, the dice are often solder mounted to a leadframe or circuit board. This solder attachment is dependent upon the thin film deposited on the backside of the wafers subsequent to wafer thinning and prior to the cutting the wafers into dice. The film that is deposited is often a tri-metal or quad-metal film.

Figure 1:
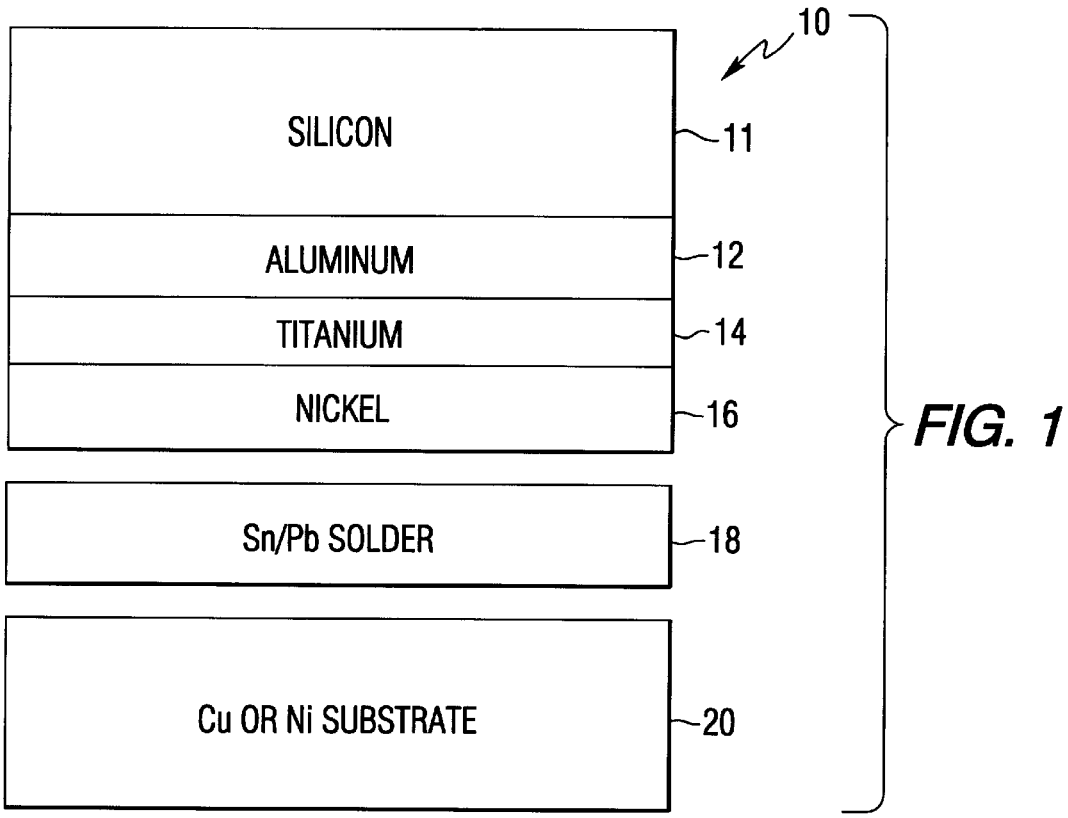
FIG. 1 is a cross section of a semiconductor wafer having a tri-metal film deposited on the non-device or backside of the wafer.
Figure 2:
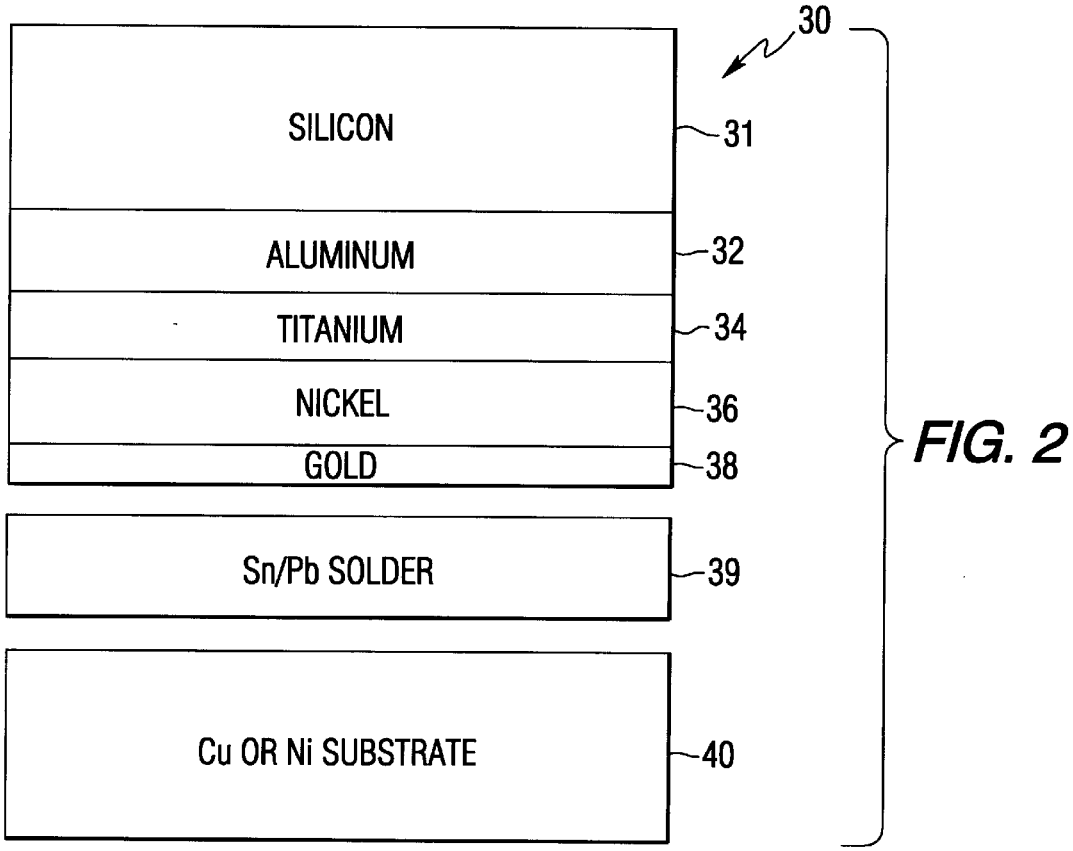
FIG. 2 is a cross section of a semiconductor wafer having an alternative quad-metal film deposited on the backside of the wafer.
Figure 3:
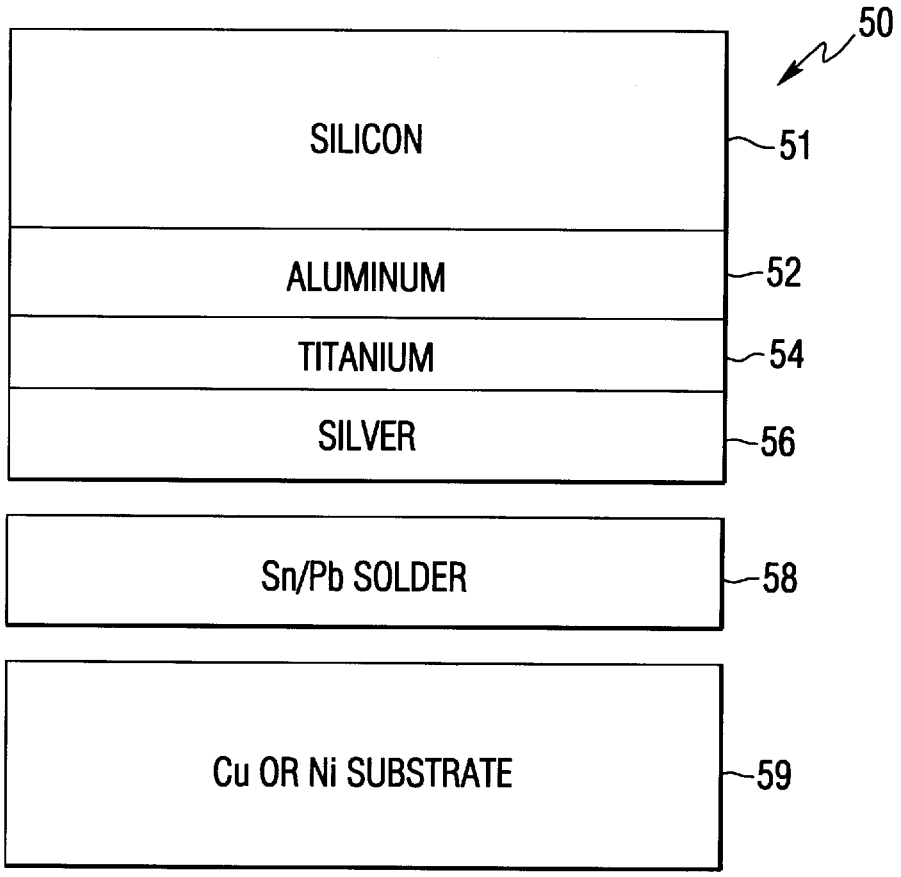
FIG. 3 is a cross section of a semiconductor wafer having an alternative tri-metal film deposited on the backside of the wafer.

As shown in FIG. 1 the typical tri-metal film structure of a semiconductor wafer 10 is silicon 11, aluminum 12, titanium 14, and nickel 16, or as shown in FIG. 2 the alternate quad-metal film structure of wafer 30 is silicon 31, aluminum 32, titanium 34, nickel 36, and gold 38. The gold 38 in the structure of FIG. 2 provides a cap to the nickel 36 and helps limit oxidation and surface contamination of the nickel 36. An alternate tri-metal semiconductor wafer 50 has a silicon 51, aluminum 52, titanium 54 and silver 56.

In all of the tri or quad metal structures the solder 18,38,58, is used to attach the cut dice from the wafers 10,30,50 to the substrate 20,40,59. The substrate 20, 40, 59 is usually copper or nickel. The solder used is generally a low temperature metal alloy.

As stated above, the use of gold 38 in the quad-metal structure and silver 56 in the tri-metal structure increases the cost substantially of processing the wafer.

The method of the present invention allows the less costly tri-metal structure of FIG. 1 to be used and provides enhanced solderability and decreased contaminants on the backside of the wafer for subsequent attachment to a substrate.

The present invention uses a two step RF plasma cleaning process. In the first step, once the wafers are thinned, the tri-metal has been deposited and the wafer processing completed, the wafers are exposed to an Argon plasma atmosphere for approximately 15 to 20 minutes. The RF Argon plasma atmosphere is maintained at 75 degrees Celsius at 0.01 Torr to 0.5 Torr of pressure at approximately 13.56 MHz, which is created by 100 W to 2 KW of power. This removes the oxides formed by exposure to air that are on the nickel 16 on the backside of the wafer 10. This plasma exposure also removes the carbonates from the nickel 16 surface and provides a clean uncontaminated nickel 16 surface.

During this argon plasma step the surface of the nickel 16 is also roughened due to the plasma cleaning. This roughened surface enhances the solderability of the nickel 16 to substrate 20 by increasing the surface area of the nickel 16.

Once the wafers are removed from the Argon plasma atmosphere the wafers are exposed to a hydrogen plasma atmosphere for approximately 5 to 10 minutes. The RF Hydrogen plasma atmosphere is maintained at approximately 75 degrees Celsius at 0.01 Torr to 0.5 Torr of pressure at approximately 13.56 MHz, which is created by 100 W to 2 KW of power. The hydrogen plasma reduces and passivates the surface of the nickel thus limiting any oxidation and inhibiting contaminants from attaching to the nickel 16 surface.

The plasma atmosphere of both steps is maintained in a plasma chamber at ambient temperature.

Once the wafers are cleaned by the present method, the wafers are cut into separate integrate circuit dice and the backside and/or front of the dice are solder wetted for attachment to the substrate(s).

The use of plasma cleaning of the present invention is far superior from any other method in that it removes not only oxides but all types of surface contaminants and allows solder wetting of the entire backside. The surface is also roughened, increasing the effective surface area of the solder attachment. Furthermore, the surface is chemically reduce by the hydrogen plasma thus inhibiting regrowth of the passivating oxide and the incorporation of other contaminants in this layer upon exposure to air. Also the wafers are not exposed to the high temperature of firing as in the past when hydrogen firing was used which may cause wafer warpage, especially on thinned wafers.

This method provides the use of the less expensive tri-metal structure without requiring the use of expensive metals such as gold or silver to enhance solderability. Also the chemical reduction of the nickel 16 surface provides a longer period of time from the time the dice are cut to the time the dice are soldered to the substrate thus maximizes the use of all of the dice that are cut from the wafer. Furthermore, the use of plasma cleaning does not present safety concerns as does hydrogen firing.

While preferred methods and embodiments of the present invention have been described, it is to be understood that the methods and embodiments described are illustrative only and the scope of the invention is to be defined solely by the appended claims when accorded a full range of equivalence, many variations and modifications naturally occurring to those of skill in the art from a perusal hereof.

What is claimed is:

1. A method of cleaning a backside of a processed semiconductor wafer also having a device side, with semiconductor integrated circuits thereon, opposite the backside, for subsequently wetting solder to the backside of the dice cut from the wafer, for attachment thereof, to a substrate, consisting of the steps of:

a first step of exposing the processed semiconductor wafer to an argon plasma atmosphere in a plasma chamber for a first period of time, for removing any carbonates, oxides and other surface contaminants from the backside of the processed semiconductor wafer; and a second step of exposing the processed semiconductor wafer to a hydrogen plasma atmosphere in the plasma chamber for a second period of time, to chemically reduce and to passivate the backside of the processed semiconductor wafer.

2. The method according to claim 1 wherein the step of exposing the semiconductor wafer to the argon atmosphere is consists of exposing the semiconductor wafer to the argon atmosphere for approximately 15 to 20 minutes.

3. The method according to claim 1 wherein the step of exposing the semiconductor wafer to the hydrogen atmosphere is consists of exposing the semiconductor wafer to the hydrogen atmosphere for approximately 5 to 10 minutes.

4. The method according to claim 1 wherein the argon and hydrogen plasma atmospheres are maintained at approximately 75 degrees Celsius, at 0.1 Torr to 0.5 Torr of pressure and at approximately 13.56 MHz at 100 W to 2 KW.

5. A method of cleaning a backside of a processed semiconductor wafer, having the backside, and a device side, opposite the backside with integrated circuits thereon, the backside of the processed semiconductor wafer being thinned and nickel being deposited on the backside for subsequently wetting solder to the nickel surface of the backside for attachment of the integrated circuit dice cut from the semiconductor wafer, consisting of the steps of:

a first step of exposing the nickel surface of the processed semiconductor wafer to an argon plasma atmosphere in a plasma chamber for a first period of time, for removing any carbonates, oxides and other contaminants from the nickel surface of the backside of the processed semiconductor wafer; and a second step of exposing the nickel surface of the processed semiconductor wafer to a hydrogen plasma atmosphere in the plasma chamber for a second period of time, to chemically reduce and to passivate the nickel surface of the backside of the processed semiconductor wafer.

6. The method according to claim 5 wherein the step of exposing the nickel surface of the semiconductor wafer to the argon plasma atmosphere is consists of exposing the semiconductor wafer to the argon plasma atmosphere for approximately 15 to 20 minutes.

7. The method according to claim 5 wherein the step of exposing the nickel surface of the semiconductor wafer to the hydrogen plasma atmosphere is consists of exposing the nickel surface of the semiconductor wafer to the hydrogen plasma atmosphere for approximately 5 to 10 minutes.

8. The method according to claim 5 wherein the argon and hydrogen plasma atmospheres are maintained at approximately 75 degrees Celsius, at 0.1 Torr to 0.5 Torr of pressure and at approximately 13.56 MHz at 100 W to 2 KW.

9. A method of cleaning a backside surface of a processed semiconductor wafer having a device side, opposite the backside, with integrated circuits thereon, the backside of the processed semiconductor wafer being thinned and a metal on the backside being deposited for subsequently attachment of the backside surface to a substrate via the metal surface of the backside surface, consisting of the steps of:

a first step of exposing the processed semiconductor wafer to an argon plasma atmosphere in a plasma chamber for a first period of time, for removing any carbonates, oxides and other surface contaminants from the backside surface of the wafer; and a second step of exposing the processed semiconductor wafer to a hydrogen plasma atmosphere in the plasma chamber for a second period of time, to chemically reduce and to passivate the backside surface of the semiconductor wafer.

10. The method according to claim 9 wherein the step of exposing the integrated circuit to the argon plasma atmosphere is consists of exposing the integrated circuit to the argon plasma atmosphere for approximately 15 to 20 minutes.

11. The method according to claim 9 wherein the step of exposing the integrated circuit to the hydrogen plasma atmosphere is consists of exposing the integrated circuit to the hydrogen plasma atmosphere for approximately 5 to 10 minutes.

12. The method according to claim 9 wherein the step of exposing to the argon and hydrogen plasma atmosphere is consists of exposing to an RF plasma atmosphere maintained at approximately 75 degrees Celsius, at 0.1 Torr to 0.5 Torr of pressure and at approximately 13.56 MHz at 100 W to 2 KW.

* * * * *